US005332149A

United States Patent [19]

Gepfer

[11] Patent Number: 5,332,149

[45] Date of Patent: Jul. 26, 1994

[54] GLUED FLAP PARTITION FOR VISIBLE CONTAINER

[75] Inventor: Richard E. Gepfer, Norcross, Ga.

[73] Assignee: Rock-Tenn Company, Norcross, Ga.

[21] Appl. No.: 83,016

[22] Filed: Jun. 25, 1993

[51] Int. Cl.[5] ..... B65D 5/48

[52] U.S. Cl. ..... 229/120.36; 229/120.38

[58] Field of Search ..... 229/120.33, 120.34, 229/120.36, 120.38; 217/22, 23, 30–33

[56] References Cited

U.S. PATENT DOCUMENTS

| | | | |
|---|---|---|---|
| 1,006,716 | 10/1911 | Bloomer . | |
| 1,312,502 | 8/1919 | Schurmann . | |
| 1,755,208 | 4/1930 | Coyle . | |
| 1,894,402 | 1/1933 | Inman . | |
| 1,963,677 | 6/1934 | Roberts . | |
| 1,975,240 | 10/1934 | Verhoven | 229/120.36 |
| 1,995,482 | 3/1935 | Plautz . | |
| 2,128,015 | 8/1938 | Sechrist . | |
| 2,151,472 | 3/1939 | Hubbard | 229/120.36 |
| 2,192,413 | 3/1940 | Reaume | 229/120.34 |
| 2,628,762 | 2/1953 | Spalding | 217/31 |
| 3,749,299 | 7/1973 | Ingle | 229/120.34 |
| 3,942,709 | 3/1976 | Gepfer . | |
| 4,621,764 | 11/1986 | Ragon . | |

FOREIGN PATENT DOCUMENTS

| | | | |
|---|---|---|---|
| 554275 | 3/1958 | Canada | 229/120.36 |
| 1441137 | 4/1966 | France | 229/120.33 |
| 27729 | 9/1932 | Netherlands | 229/120.36 |

*Primary Examiner*—Gary E. Elkins
*Attorney, Agent, or Firm*—Rogers, Howell & Haferkamp

[57] ABSTRACT

A lattice of partition panels is used inside a container to separate articles packaged in the container where the container may be cut along its side walls to remove a top portion of the container to expose the articles packaged therein with none of the partition panels of the lattice obstructing a view of the articles by projecting above a top edge of the container walls.

16 Claims, 2 Drawing Sheets

GLUED FLAP PARTITION FOR VISIBLE CONTAINER

BACKGROUND OF THE INVENTION (1) Field of the Invention

The present invention pertains to a lattice of partition panels that is used inside a container to separate articles packaged in the container, where the container may be cut along its side walls to remove a top portion of the container to expose the articles packaged therein with none of the partition panels of the lattice obstructing a view of the articles by projecting above the cut top edge of an adjacent container wall.

(2) Description of the Related Art

Partition panels are commonly used in carton packaging, such as cardboard or paperboard boxes, for separating articles packaged in the boxes and preventing the articles from contacting with each other when shipped or stored. This is particularly true for glass articles, such as bottles and other similar articles, but is also true in packaging easily bruised food items such as fruits and vegetables and in packaging eggs. A typical partition lattice is comprised of several panels arranged in a crisscrossing pattern in the interior of the carton where the crisscrossing panels define several separate storage areas in the carton interior. Prior art partition panels typically extend from the bottom to the top of the container and provide added compression strength to the container in addition to separating the container interior into separate storage areas. Examples of these partition panel lattices are shown in the U.S. Patents of Coyle U.S. Pat. No. 1,755,208; Roberts U.S. Pat. No. 1,963,677; and Plautz U.S. Pat. No. 1,995,482.

A prior art lattice of partition panels is typically comprised of several rectangular sheets of paperboard or cardboard or other similar material. The panels are provided with pluralities of slots extending partially across their widths. The panels are arranged perpendicular to each other and the slots are interlocked to assemble the lattice of panel partitions. The lattice of panels is then inserted into the carton interior to divide the interior into separate areas, each to receive an article to be packaged in the container.

In the simple construction of prior art carton partitions described above, it was often found that the lattice of partition panels would not retain the rectangular or boxlike configuration of the areas defined by the crisscrossing panels, and would often become askew after being positioned in the carton interior making it difficult to insert articles into each of the areas defined by the crisscrossing panels. Where cartons are packaged manually, the partition panels becoming askew in the carton was not a great problem as the partitions could be manipulated to their desired crisscrossing configuration as articles are manually inserted into the separate areas defined by the crisscrossing panels. However, in assembly lines where machines are employed to both insert the lattice of partition panels into the carton interior and then insert articles into each of the separate areas defined by the crisscrossing panels, should the lattice of panels become askew in the carton interior it would often prevent the machines from properly inserting articles into the carton.

Partition panel lattices have been developed where an indexing or positioning panel is added to the lattice to maintain the crisscrossing panels of the lattice in their proper perpendicular relative positions once inserted into the carton interior. The positioning or indexing strip is typically secured to one or more partition panel edges and is positioned in the carton interior against one of the carton walls to maintain the crisscrossing panels in their perpendicular relative positions. However, this improved partition panel lattice was found to be disadvantaged when used with cartons that are also intended to be used as displays for the packaged goods in warehouse-type stores where goods are displayed in their shipping cartons.

Typically, in displaying articles in warehouse-type stores, the shipping carton is cut horizontally across each of its four side walls and the top portion of the carton is removed, exposing the articles contained in the carton. However, when employing the prior art partition panel lattice which includes an indexing or positioning panel that extends along one of the carton side wall interiors, when the top portion of the carton is cut away, the indexing or positioning panel projects above the cut top edge of the carton walls to the height of the original carton wall, thereby obstructing the view of the articles contained in the carton over the carton wall adjacent the indexing or positioning partition panel.

SUMMARY OF THE INVENTION

The present invention provides a lattice of partitioning panels that includes an indexing or positioning panel in the lattice. The positioning panel is dimensioned so that it will not obstruct the view of the articles packaged in a container employing the lattice of the invention. The lattice of panels may be employed in a conventional packaging container or carton where a top portion of the container is cut away and removed to display the container contents. The lattice may also be employed in an open top container having side walls of the same heights as the positioning panel of the lattice where the articles contained in the container and lattice are covered by a transparent shrink-wrap.

The lattice of the present invention is used in the interior of a conventional box container having a bottom surrounded by four walls that project vertically upward from the peripheral edge of the bottom. The lattice is generally comprised of a plurality of crisscrossing panels, each having one or more slots extending partially through their widths. The panels are arranged generally perpendicular to each other, and the slots are interlocked to connect the panels together in their crisscrossing lattice configuration. The vertical height of each of the crisscrossing panels is determined to match the vertical height of the carton walls so that when the lattice of panels is inserted into the carton interior it extends upward in the interior until the top edges of the crisscrossing panels are positioned in substantially the same plane as the top edges of the carton walls. However, the positioning panel of the lattice does not have the same vertical height as the remaining crisscrossing panels of the lattice, but is smaller than these panels. The positioning panel is secured to the edges of one or more of the partitioning panels by flaps provided at the edges of the partitioning panels that are adhered to the positioning panel. The positioning panel maintains the relative perpendicular orientation between the crisscrossing partitioning panels inserted into the carton interior but does not obstruct the view of articles contained in the separate areas defined by the crisscrossing partition panels when the top portion of the carton is cut away.

Preferably, a cut line will be shown on the exterior of the carton walls to indicate where the carton wall should be cut to remove the top portion of the carton and expose the articles packaged in the container. The vertical height of the positioning panel is determined to coincide with the vertical height of the cut line appearing on the sides of the carton walls. When the carton walls are cut along the cut line and the top portion of the carton is removed, the top edge of the positioning panel will coincide with the cut top edge of the carton walls. The crisscrossing partition panels will extend above the cut top edge of the carton wails to the original height of the carton walls, but the positioning panel will not extend vertically beyond the cut top edge of the carton walls and therefore will not obstruct the view of the articles contained in the carton interior.

BRIEF DESCRIPTION OF THE DRAWINGS

Further objects and features of the present invention are revealed in the following detailed description of the preferred embodiment of the invention and in the drawing figures wherein.

DESCRIPTION OF THE PREFERRED EMBODIMENT

Figure 1:
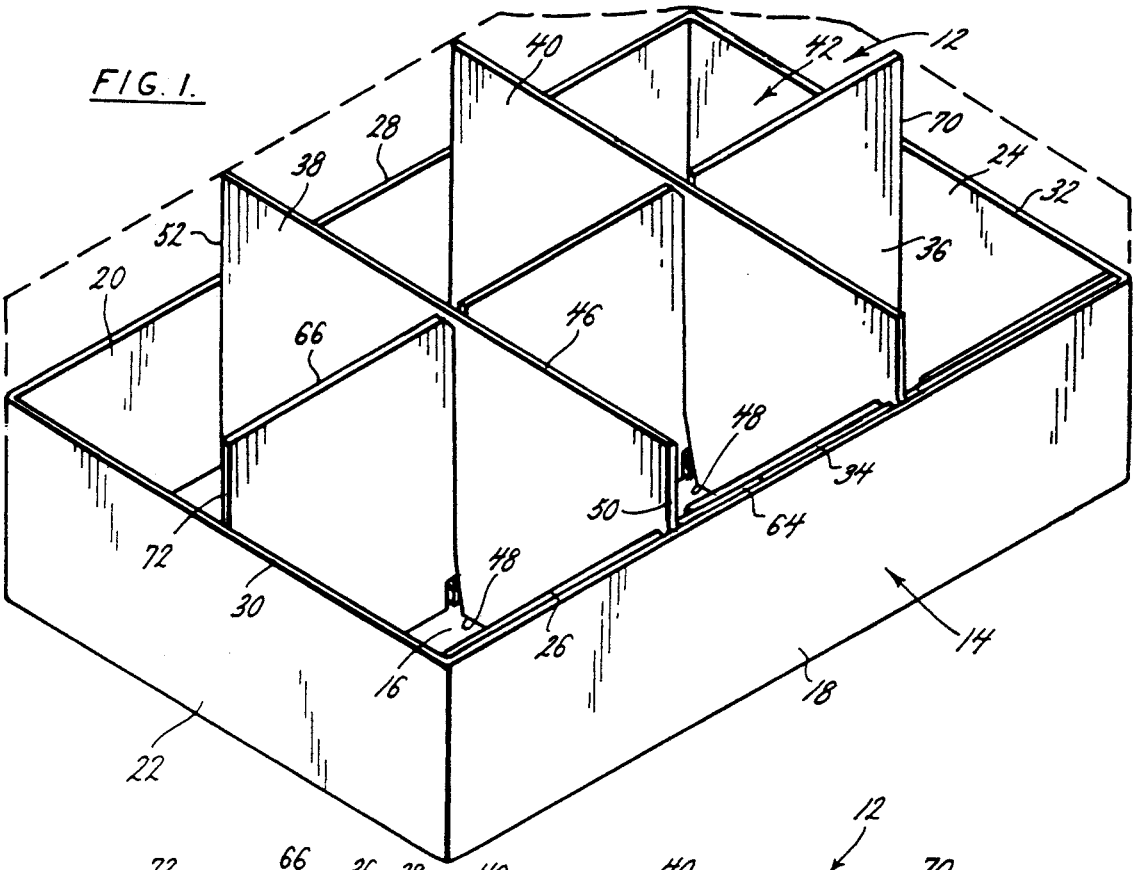
FIG. 1 is a perspective view of the lattice of partition panels of the present invention inserted into the interior of a carton having its top portion cut and removed.
Figure 2:
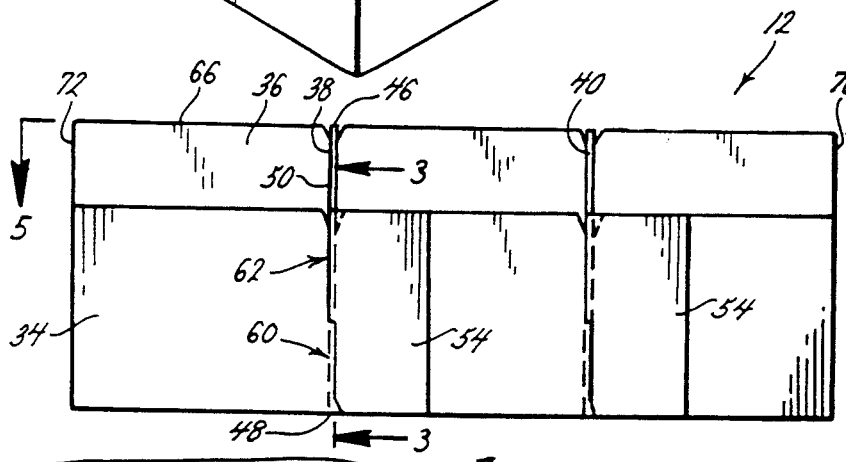
FIG. 2 is a front elevation view of the partition panel lattice of the present invention removed from the carton interior.

FIG. 1 shows the lattice of partition panels 12 of the present invention positioned in a conventional container or box 14 which has already had its top portion cut away and removed. Alternatively, the lattice of the invention 12 may be employed with an open top container having side walls of the same height as the positioning panel of the lattice where articles contained in the container and lattice are covered by a transparent shrink-wrap. It should be understood that the lattice of the invention may be employed with a variety of different types of containers other than the type referred to in describing the use of the lattice and the description of the lattice as being used with a conventional container or box 14 should not be interpreted as limiting the scope of the claims. In the described embodiment of the invention, the lattice 12, like the conventional box or carton 14, is constructed entirely of paperboard or cardboard, or an equivalent material. However, it should be understood that the lattice may be constructed of other similar materials without departing from the intended scope of the invention. The lattice 12 may be constructed in a variety of different sizes having different dimensions to suit the lattice for use with any particular size carton.

The carton itself is generally comprised of a bottom wall 16 having a generally rectangular configuration. Laterally opposite front 18 and back 20 walls extend upward from the periphery of the carton bottom wall, and longitudinally opposite left side 22 and right side 24 walls extend upward from the periphery of the bottom. Flaps (not shown) are connected along the top edges of the front and back walls 18, 20 and left and right side walls 22, 24 and are folded over the top opening of the carton once the lattice of partitions 12 and the articles to be packaged in the carton are inserted through the top opening. The construction of the carton 14 set forth above is conventional and only one example of how conventional cartons are constructed. It should be understood that the particular construction of the carton employed with the lattice 12 of the invention may be varied so long as the longitudinal, lateral and vertical dimensions of the lattice 12, yet to be described, are determined to best suit the lattice for use in the interior of the particular carton. The carton 14 employed with the lattice 12 of the invention is shown in FIG. 1 with a bottom portion of the carton depicted in solid lines and a top portion of-the carton that has been cut away to display the contents of the carton shown in dashed lines. To assist in cutting and removing the top portion of the carton, a cut line is preferably indicated around the periphery of the carton exterior surface. With the top portion of the carton cut away, the front and back walls 18, 20 have top edges 26, 28, respectively, and the left and right side walls 22, 24 have top edges 30, 32, respectively, that are all produced by cutting away the top portion of the carton.

The lattice 12 of the invention is generally comprised of a front positioning panel 34, an intermediate panel 36, and left and right side panels 38, 40. The configuration of the lattice 12 formed by these four intersecting panels defines six separate areas in the carton interior 42 for containment of articles to be packaged in the carton 14. It should be appreciated that by deleting one of the side panels 38, 40 and correspondingly dimensioning the front and intermediate panels 34, 36, the lattice 12 can be reduced in size to separate only four articles placed in the carton interior 42. Likewise, by adding additional panels parallel to the intermediate and forward panels 36, 34 and/or adding additional side panels parallel to the left and right side panels 38, 40, and by dimensioning the panels appropriately, additional separate areas defined by the intersecting panels of the lattice may be formed. Despite the addition or deletion of partition panels, the number of separated areas defined by the intersecting panels of the lattice 12 may be varied to suit the lattice for use in any desired application.

Figure 8:
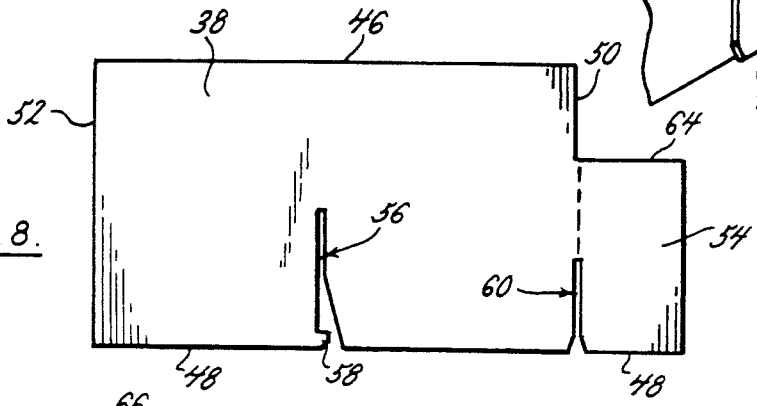
FIG. 8 is an elevation view of one of the partition panels of the lattice of the invention.

FIG. 8 shows a side elevation view of the left side panel 38 of the lattice. The left and right side panels 38, 40 are substantially identical in their construction so only the left side panel 38 will be described. As seen in FIG. 8, the panel has a generally rectangular configuration with opposite top 46 and bottom 48 edges and opposite front 50 and back 52 edges. A flap 54 is connected integrally to the panel front edge. A slot 56 extends upward from the bottom edge 48 partially through the vertical width of the panel. The slot 56 is widened at its bottom adjacent the panel bottom edge 48 and a shoulder 58 projects into the widened area of the slot. A second slot 60 extends upward from the panel bottom edge 48 partially through the vertical width of the panel. The second slot 60 partially separates the flap 54 from the remainder of the side panel 38 and extends substantially parallel to the panel front edge 50. A fold line 62 extends between the panel front edge 50 and the second slot 60 separating the panel 38 and the flap 54.

As seen in FIG. 8, the flap 54 has a bottom edge that is a continuation of the panel bottom edge 48. However, the flap top edge 64, although parallel to the panel top edge 46, is spaced vertically below the panel top edge. The vertical height dimensions of the panel measured between its bottom 48 and top edges 46 and the vertical height dimensions of the flap measured between its bottom 48 and top 64 edges are determined dependent on the dimensions of the particular carton 14 with which the panel of the lattice is to be used. The vertical height of the panel 38 between its bottom and top edges is determined to be substantially equal to that of the total vertical height of the carton walls prior to the carton being cut along the cut line and the top portion of the carton removed. The lateral length of the side panel 38 between its front 50 and back 52 edges is substantially equal to the lateral length of the carton interior. As seen in FIG. 1, both side panels 38, 40 extend laterally across the carton interior 42 between the carton front wall 18 and back wall 20.

Also show in FIG. 1, the flaps 54 of both side panels 38, 40 are folded perpendicular relative to the panels and parallel relative to the carton front wall 18. The positioning of the flaps 54 will be described in more detail in describing their connection to the front positioning panel 34 of the lattice. As seen in FIG. 1, the vertical height dimension of the flap between its top edge 64 and bottom edge 48 is determined to be substantially equal to the vertical height of the carton walls after the walls have been cut along the cut line and the top portion of the carton removed. This accounts for the difference in the vertical height between the flap 54 and its associated panel 38. As stated earlier, both the left and right side panels 38, 40 are formed substantially identical to each other.

Figure 9:
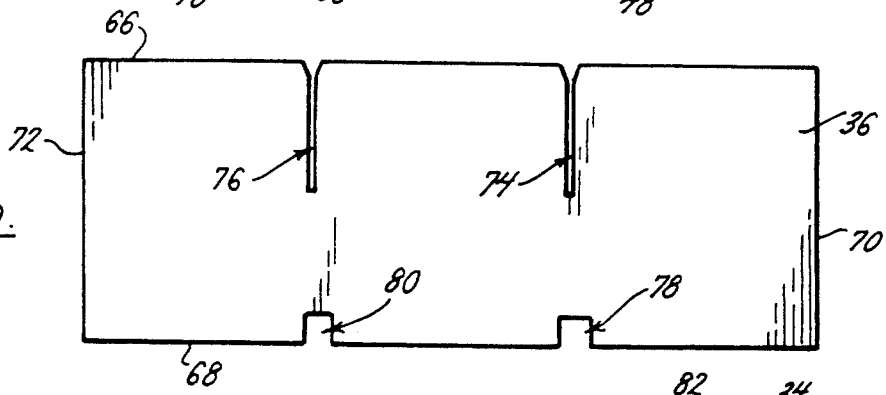
FIG. 9 is an elevation view of another of the partition panels of the lattice of the invention.
Figure 10:
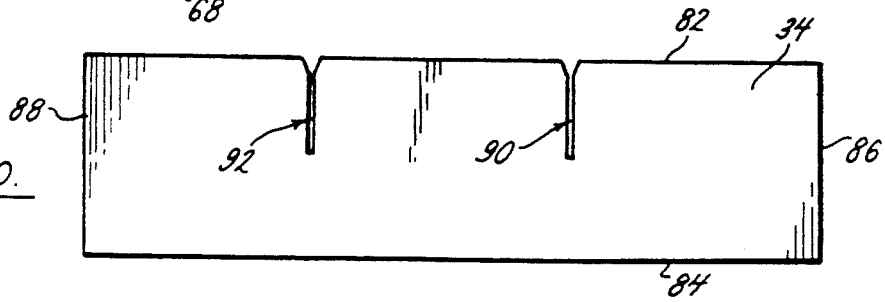
FIG. 10 is an elevation view of the positioning panel of the lattice of the invention.

The intermediate panel 36 shown in FIG. 9 has a general rectangular configuration defined by a top edge 66, a bottom edge 68, and right 70 and left 72 side edges. The vertical height of the intermediate panel 36 is substantially equal to that of the left and right side panels 38, 40 and is substantially equal to that of the carton walls prior to the top portion of the carton being cut away and removed. The longitudinal length dimension of the intermediate panel 36 is substantially equal to that of the carton interior 42 between the left and right side walls 22, 24 of the carton. This enables the intermediate panel 36 to be placed in the carton interior 42 spanning the longitudinal length of the interior as shown in FIG. 1. A pair of slots 74, 76 extend downward from the intermediate panel top edge 66 partially through the vertical width of the panel. The slots 74, 76 are longitudinally spaced along the panel dividing the panel into three substantially equal sized sections. A pair of notches 78, 80 are formed extending upward from the panel bottom edge 68 directly below the pair of slots 74, 76. The notches 78, 80 are provided to receive the side panel shoulders 58 in assembling the partition panels into the lattice of the invention, as will be explained.

The lattice front or positioning panel 34 also has a general rectangular configuration defined by vertically opposite top 82 and bottom 84 edges and longitudinally opposite right side 86 and left side 88 edges. The longitudinal length of the front panel 34 is substantially equal to that of the intermediate panel 36 and is determined to enable the positioning panel to be placed in the carton interior 42 spanning the longitudinal length of the interior between the carton left and right side walls 22, 24. This positioning of the front panel 34 in the carton interior is shown in FIG. 1. The vertical height dimension of the positioning panel between its top 82 and bottom 84 edges is determined to be substantially equal to the vertical height of the carton side walls after the side walls have been cut and the top portion of the carton has been removed. This enables the positioning panel 34 to be inserted into the carton interior adjacent the cut carton front wall 18 and to extend vertically upward to where the positioning panel top edge 82 is adjacent the cut top edge of the carton front wall 18 and does not project above the cut top edge of the carton front wall. A pair of slots 90, 92 extend downward from the positioning panel top edge 82 partially through the vertical width of the panel. The slots 90, 92 are longitudinally spaced along the length of the positioning panel and divide the panel into three substantially equal segments.

Figure 3:
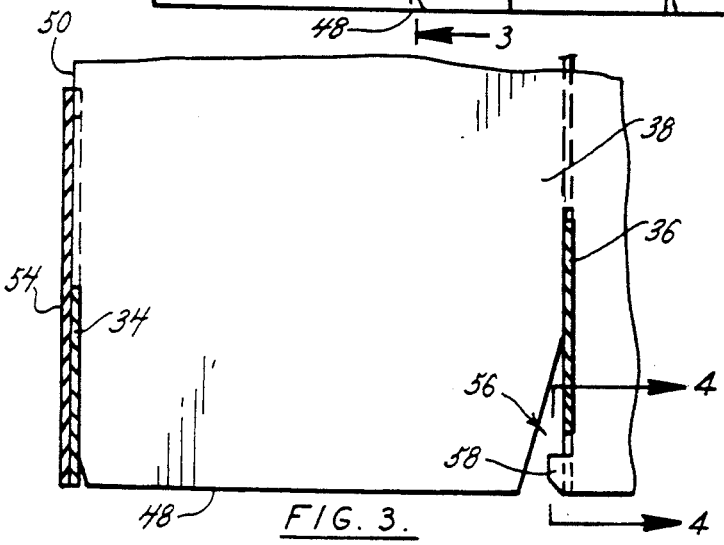
FIG. 3 is a partial elevation view, in section, of the lattice taken along the line 3—3 of FIG. 2.
Figure 4:
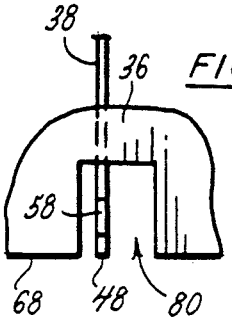
FIG. 4 is a partial elevation view of the lattice taken along the line 4—4 of FIG. 3.
Figure 5:
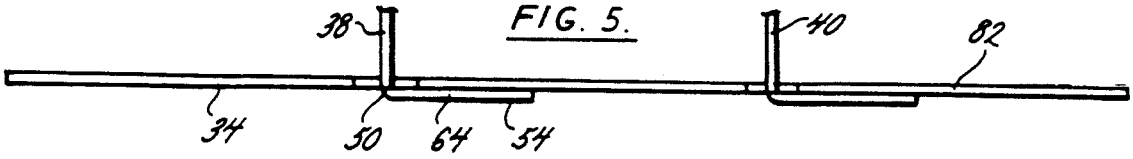
FIG. 5 is a partial plan view of the lattice taken along the line 5—5 of FIG. 2.
Figure 7:
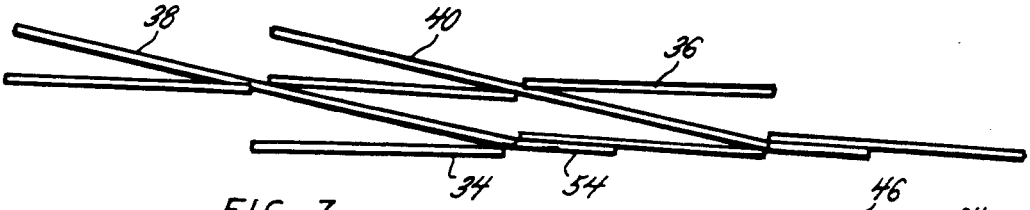
FIG. 7 is a plan view of the lattice of the invention shown as it is moved toward its collapsed position.
Figure 6:
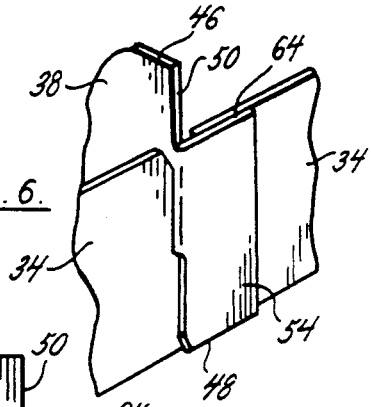
FIG. 6 is a partial perspective view of a connection between a flap at the edge of a partition panel and the positioning panel.

In assembling the lattice of partition panels 12 of the present invention, the intermediate panel 36 and front positioning panel 34 are first placed in a vertical orientation on their respective bottom edges 68, 84 where the two panels are substantially parallel to each other but are spaced laterally from each other, the spaced distance being substantially equal to the spacing between the first and second slots 50, 60 of the left and right side panels 30, 32. With the intermediate and front panels 36, 34 held in these relative positions, one of the left or right side panels 38, 40 is then assembled to the front and intermediate panels by positioning the side panel perpendicularly over the front and intermediate panels with the side panel slots positioned directly above the left or right hand slots of the intermediate and front panels. The side panel is then pushed downward onto the intermediate panel and the front panel causing the side panel slots to interlock with the intermediate panel and front panel slots. The side panel is pushed downward until its top edge and the top edge of the intermediate panel are positioned in substantially the same plane and the side panel flap top edge and the top edge of the front panel are positioned in substantially the same plane. In this relative positioning of the side panel and the intermediate and front panels, the side panel shoulder 58 will engage through one of the intermediate panel notches as best seen in FIGS. 3 and 4, thereby locking the side panel to the intermediate panel. The side panel flap 54 is then folded along its fold line 62 and adhered to the front partition panel 34 in the relative positions of the flap and panel shown in FIG. 6, completing the assembly of the side panel to the intermediate and front positioning panels of the lattice. The second side panel is assembled to the front and intermediate panels in the same manner as described above to complete the construction of the lattice 12. With the lattice constructed in the manner described above, it is capable of being folded flat as shown in FIG. 7. The lattice 12 may be stored or shipped in the flat folded orientation requiring a minimum of space.

With the lattice 12 assembled from the partition panels as described above, and with the lattice unfolded from its flat configuration so that the intermediate 36 and front positioning panels 34 are substantially perpendicular to the left and right side panels 38, 40, the lattice is then inserted into the carton interior 42 in the position shown in FIG. 1. As seen in FIG. 1, the intersecting panels of the lattice divide the carton interior into six separate areas for insertion of articles to be shipped and/or stored in the carton. After the carton reaches its destination and it is desired to employ the carton as a display for the articles packaged in the carton, the carton is cut along a cut line that extends around the four side walls. As explained earlier, the cut line will be delineated on the exterior surface of the carton side walls and will be positioned at a vertical height on the carton side walls coinciding with the vertical height of the lattice front positioning panel 34. After the side walls are cut and the top portion of the carton is removed, the top edge of the front positioning panel 34 will coincide with the top cut edge of the carton front wall 18 and will not project above this edge. In this manner, the front positioning panel 34 will not obstruct the view of the articles contained in the separate areas of the carton interior defined by the intersecting intermediate panel 36 and left and right side panels 30, 32.

While the present invention has been described by reference to a specific embodiment, it should be understood that modifications and variations of the invention may be constructed without departing from the scope of the invention defined in the following claims.

What is claimed is:

1. A lattice of partition panels for use in a carton having an interior with a longitudinal length and a lateral length, the interior being defined by a bottom surrounded by laterally opposite front and back walls and longitudinally opposite left and right side walls, the walls all having substantially equal vertical heights, the lattice comprising:

an intermediate panel having a longitudinal length substantially equal to the longitudinal length of the carton interior enabling the intermediate panel to be placed in the carton interior spanning the longitudinal length of the carton, the intermediate panel having a vertical height greater than the vertical height of the carton walls;

a front panel spaced laterally from the intermediate panel, the front panel having a longitudinal length substantially equal to the longitudinal length of the intermediate panel and having a vertical height less than the vertical height of the intermediate panel and substantially equal to the vertical height of the carton walls enabling the front panel to be placed in the carton interior against the front wall and spanning the longitudinal length of the carton without the front panel projecting above the front wall and obstructing a view of the carton interior; and a left side panel and a right side panel substantially identical to each other, each said side panel having a lateral length substantially equal to the lateral length of the carton interior enabling each said side panel to be placed in the carton interior spanning the lateral length of the carton, the left and right panels having vertical heights greater then the vertical height of the carton walls and substantially equal to the vertical height of the intermediate panel; and, a flap secured to a forward edge of the left side panel and a flap secured to the forward edge of the right side panel, each said flap being secured to the front panel thereby securing the left and right side panels to the front panel, and each side flap having a vertical height less than the vertical height of the left and right side panels and substantially equal to the vertical height of the front panel.

2. The lattice of claim 1, wherein:

the flaps are secured to the forward edges of the left and right side panels along fold lines, and the flaps are folded substantially perpendicular relative to their respective left and right side panels and the flaps are secured to the front panel, thereby positioning the left and right side panels substantially perpendicular relative to the front panel.

3. The lattice of claim 1, wherein:

the front and intermediate panels and the left and right side panels each have pluralities of slots extending partially through the panels, and the slots of the front and intermediate panels engage over portions of the left and right side panels and the slots of the left and right side panels engage over portions of the front and intermediate panels thereby forming the lattice from the panels and securing the panels to each other.

4. The lattice of claim 1, wherein;

the front and intermediate panels and the left and right side panels are interconnected in the carton interior where the front and intermediate panels are substantially perpendicular to the left and right side panels thereby dividing the carton interior into a plurality of separate compartments.

5. The lattice of claim 1, wherein:

the left and right side panels each have a general rectangular configuration with opposite top and bottom edges and opposite forward and back edges, and each said flap has a general rectangular configuration with opposite top and bottom edges and opposite front and back edges, the forward edges of the left and right side panels are connected to the back edges of the flaps and the top edges of the flaps project substantially perpendicular from the forward edges of the left and right side panels.

6. The lattice of claim 1, wherein:

the left and right side panels each have a general rectangular configuration with opposite top and bottom edges and opposite forward and back edges, and each said flap has a general rectangular configuration with opposite top and bottom edges and opposite front and back edges, the forward edges of the left and right side panels are connected to the back edges of the flaps and the top edges of the side panels are displaced vertically from the top edges of the flaps.

7. The lattice of claim 6, wherein:

the top edges of the side panels are substantially perpendicular to the top edges of the flaps.

8. The lattice of claim 1, wherein:

the intermediate panel and the left and right side panels all have top edges that are substantially coplanar and the front panel and the front and back walls and left and right side walls of the carton all have top edges that are all substantially coplanar, and the plane of the intermediate panel and left and right side panel top edges is positioned vertically above the plane of the front panel and carton wall top edges.

9. A lattice of partition panels for use in a carton having an interior with a longitudinal length and a lateral length, the interior being defined by a bottom surrounded by laterally opposite front and back walls and longitudinally opposite left and right side walls, the walls all having substantially equal vertical heights, the lattice comprising:

an intermediate panel having a longitudinal length substantially equal to the longitudinal length of the carton interior enabling the intermediate panel to be placed in the carton interior spanning the longitudinal length of the carton, the intermediate panel having a vertical height greater than the vertical height of the carton walls;

a front panel spaced laterally from the intermediate panel, the front panel having a longitudinal length substantially equal to the longitudinal length of the intermediate panel and having a vertical height less than the vertical height of the intermediate panel and substantially equal to the vertical height of the carton walls enabling the front panel to be placed in the carton interior against the front wall and spanning the longitudinal length of the carton without the front panel projecting above the front wall and obstructing a view of the carton interior; and, at least one side panel having a lateral length substantially equal to the lateral length of the carton interior enabling the side panel to be placed in the carton interior spanning the lateral length of the carton, the side panel having a vertical height greater than the vertical height of the carton walls and substantially equal to the vertical height of the intermediate panel; and, a flap secured to a forward edge of the side panel, the flap being secured to the front panel thereby securing the side panel to the front panel, and the flap having a vertical height less than the vertical height of the side panel and substantially equal to the vertical height of the front panel.

10. The lattice of claim 9, wherein:

the flap is secured to the forward edge of the side panel along a fold line, and the flap is folded substantially perpendicular relative to the side panel and the side panel is substantially perpendicular relative to the front panel.

11. The lattice of claim 9, wherein:

the front and intermediate panels and the side panel each have pluralities of slots extending partially through the panels, and the slots of the front and intermediate panels engage over portions of the side panel and the slots of the side panel engage over portions of the front and intermediate panels thereby forming the lattice from the panels and securing the panels to each other.

12. The lattice of claim 9, wherein;

the front and intermediate panels and the side panel are interconnected in the carton interior where the front and intermediate panels are substantially perpendicular to the side panel thereby dividing the carton interior into a plurality of separate compartments.

13. The lattice of claim 9, wherein:

the side panel has a general rectangular configuration with opposite top and bottom edges and opposite forward and back edges, and the flap has a general rectangular configuration with opposite top and bottom edges and opposite forward and back edges, the front edge of the side panel is connected to the back edge of the flap and the top edge of the flap projects substantially perpendicular from the front edge of the side panel.

14. The lattice of claim 9, wherein:

the side panel has a general rectangular configuration with opposite top and bottom edges and opposite front and back edges, and the flap has a general rectangular configuration with opposite top and bottom edges and opposite front and back edges, the front edge of the side panel is connected to the back edge of the flap and the top edge of the side panel is displaced vertically from the top edge of the flap.

15. The lattice of claim 9, wherein:

the top edge of the side panel is substantially perpendicular to the top edge of the flap.

16. The lattice of claim 9, wherein:

the intermediate panel and the side panel have top edges that are substantially coplanar and the front panel and the front and back walls and left and right side walls of the carton all have top edges that are all substantially coplanar, and the plane of the intermediate and side panel top edges is positioned vertically above the plane of the front panel and carton wall top edges.

* * * * *